US009701519B2

(12) United States Patent
Boroy

(10) Patent No.: US 9,701,519 B2
(45) Date of Patent: Jul. 11, 2017

(54) LIFTING TOOL FOR OPPOSING TWISTING OF GENERALLY SUBMERGED ROPES

(75) Inventor: Yngvar Boroy, Sogne (NO)

(73) Assignee: National Oilwell Varco Norway, AS, Kristiansand S (NO)

( * ) Notice: Subject to any disclaimer, the term of this patent is extended or adjusted under 35 U.S.C. 154(b) by 498 days.

(21) Appl. No.: 13/883,169

(22) PCT Filed: Nov. 2, 2011

(86) PCT No.: PCT/NO2011/000308

§ 371 (c)(1),
(2), (4) Date: Jun. 4, 2013

(87) PCT Pub. No.: WO2012/060715

PCT Pub. Date: May 10, 2012

(65) Prior Publication Data

US 2013/0241221 A1 Sep. 19, 2013

(30) Foreign Application Priority Data

Nov. 3, 2010 (NO) ..... 20101540

(51) Int. Cl.
*B63B 27/00* (2006.01)
*B66C 13/04* (2006.01)
*B66C 13/08* (2006.01)

(52) U.S. Cl.
CPC ..... *B66C 13/04* (2013.01); *B66C 13/08* (2013.01)

(58) Field of Classification Search
CPC ... B63B 21/04; B63B 21/18; B63B 2027/165; B66C 13/04; B66C 13/08
USPC ..... 414/137.1–143.2
See application file for complete search history.

(56) References Cited

U.S. PATENT DOCUMENTS 3,176,327 A * 4/1965 Oberth ..... B64D 1/22 244/31
3,724,061 A * 4/1973 Schipper ..... 29/464
4,214,842 A * 7/1980 Franks ..... E21B 43/017 166/341
6,883,453 B1 * 4/2005 Mulhern ..... 114/253
7,035,758 B1 * 4/2006 Jerome ..... B66C 13/04 702/150
7,568,443 B2 * 8/2009 Walker ..... B63B 39/06 114/162

(Continued)

FOREIGN PATENT DOCUMENTS

EP 0806775 A1 11/1997
EP 1288157 B1 9/2004

(Continued)

OTHER PUBLICATIONS

PCT/NO2011/000308 International Written Opinion dated Jan. 27, 2012 (4 p.).

*Primary Examiner* — Michael McCullough
*Assistant Examiner* — Lynn Schwenning
(74) *Attorney, Agent, or Firm* — Conley Rose, P.C.

(57) ABSTRACT

A lifting tool for opposing twisting of generally submerged ropes. The lifting tool includes a body with a center axis, an operable lock configured to selectively limit movement of a rope connector through the body, and a structure coupled to the body and configured to couple to a hoist or crane. The lifting tool also includes at least one rudder positioned at a radial distance from the center axis to oppose rotation of the lifting tool.

13 Claims, 4 Drawing Sheets

(56) References Cited

U.S. PATENT DOCUMENTS

| | | | | |
|---|---|---|---|---|
| 7,976,246 | B1 * | 7/2011 | Krabbendam | 405/224 |
| 8,882,427 | B2 * | 11/2014 | Boroy | 414/137.7 |
| 2005/0191165 | A1 | 9/2005 | Willis | |
| 2008/0105432 | A1 * | 5/2008 | Zemlak | E21B 19/146 166/336 |
| 2009/0261052 | A1 * | 10/2009 | Vasstrand | 212/270 |
| 2011/0203803 | A1 * | 8/2011 | Zemlak | E21B 19/146 166/349 |
| 2012/0156003 | A1 * | 6/2012 | Battersby et al. | 414/803 |
| 2012/0269579 | A1 * | 10/2012 | Ardavanis | 405/166 |

FOREIGN PATENT DOCUMENTS

| | | | |
|---|---|---|---|
| JP | 7267580 | A | 10/1995 |
| NO | 329383 | A | 10/2010 |
| WO | 0170568 | A1 | 9/2001 |
| WO | 2010093251 | A | 8/2010 |

* cited by examiner

LIFTING TOOL FOR OPPOSING TWISTING OF GENERALLY SUBMERGED ROPES

CROSS-REFERENCE TO RELATED APPLICATIONS

This application is the U.S. National Stage filing made under 35 U.S.C. §371 of International Application No. PCT/NO2011/000308 filed Nov. 2, 2011, which claims priority to Norwegian Patent Application No. 20101540 filed Nov. 3, 2010, entitled "Lifting Tool For Opposing Twisting Of Generally Submerged Ropes."

STATEMENT REGARDING FEDERALLY SPONSORED RESEARCH OR DEVELOPMENT

Not applicable.

BACKGROUND

The present disclosure relates to a lifting tool for opposing twisting of generally submerged ropes. More precisely, the present disclosure relates to a lifting tool for opposing twisting of generally submerged ropes where the lifting tool comprises a body having an operable lock that is adapted to catch a rope connector, and a structure that is designed to be connected to a hoist or a crane.

During hoisting operations at sea where heavy items having weights on the order of several hundred tons are to be disposed on the seabed, the availability of steel ropes having sufficient combined strength and length has become a limiting factor for the size of items that can be handled. The seabed may be located several kilometers below sea level, and the weight of the steel rope therefore becomes significant.

It may therefore be necessary to use fiber ropes that have a density close to that of water, to allow the largest items to be submerged into deep waters.

The use of fiber ropes for operations of this type requires consideration of conditions not normally problematic when using steel ropes. For example, the effective life of a fiber rope, which includes a significant proportion of carbon fiber, depends directly on the number of load-related flexures that the fiber rope is exposed to.

Oftentimes, hoisting operations of this type are heave-compensated, and the lifting rope will therefore be continuously reeled in and out from a winch due to the heave motion of the lifting vessel. Even if the item being lifted is stationary relative to the seabed, the lifting rope will still be reeled in and out, whereby the effective life of a fiber rope is reduced relatively quickly.

Norwegian Patent Application 20090729 discloses a method for paying out a relatively long fiber rope, which carries a load, by means of a shorter steel rope. The method, which includes the use of parallel ropes, is explained in detail in that application document.

A problem when utilizing parallel ropes is the tendency of the rope to twist and to get entangled in each other. As the ropes have to be moved independently of each other in the sea, an entanglement may in a worst case lead to cutting of the ropes and loss of a valuable item.

SUMMARY

An object of the present disclosure is to remedy or reduce at least one of the disadvantages associated with the prior art.

In accordance with various embodiments, a lifting tool is provided for opposing twisting of generally submerged ropes. The lifting tool comprises a body with a center axis, an operable lock configured to catch a rope connector, and a structure that is configured to connect to a hoist or a crane. The lifting tool is equipped with at least one water flow inducing means positioned at a radial distance from the center axis.

The water flow inducing means may be adjustable and include one or more of a thruster, a nozzle or a rudder.

When lifted or lowered through the sea, the thruster, the nozzle or rudder may be adjusted to oppose a torque from one or both ropes. By measuring one or more physical features such as the rotational acceleration or inclination using various sensors, the thruster, the nozzle or the rudder may be adjusted autonomously by a control unit and actuator, remotely by an operator, or by a combination thereof to counteract such a torque.

The lifting tool may include a pair of thrusters, nozzles and rudders where the thrusters, nozzles or rudders are positioned on opposite sides of the lifting tool. When adjusting the pair of thrusters, nozzles or rudders properly, a couple acting about the central axis of the payload carrying rope may be generated.

The rudder may be turnable about an axis laid out in the direction of the span of the rudder. Thus the rudder may be balanced so that less torque is needed in adjusting the rudder.

The thrusters, nozzle or rudder may be connected to an actuator for the adjustment about said axis. Energy for operation of the actuator and for the thrusters may be stored on the lifting tool.

The energy may for instance be stored in the form of a pressurized fluid or an electrical charge (e.g., in a battery).

Water flow for the nozzle may be generated from the speed of the lifting tool through the sea. The nozzle inlet may be positioned in the lifting direction, while the outlet of the nozzle may be directed tangentially relative the lifting tool body.

It may be advantageous to combine a thruster for use when the lifting tool is stationary in the sea, and a rudder for use when the lifting tool is at speed, this in order to conserve energy. While in motion, a thruster may be used for generating energy. The thruster and rudder may be one unit or separate items The lifting tool may, when it is connected to the steel rope and either moving along, or carrying the fiber rope, oppose the rotational forces typically generated by torque from the ropes, sea current and vortex shredding, and acting on the lifting tool. Thus, the lifting tool may, when having a speed through the sea, largely prevent the twisting and entanglement between parallel ropes in the sea.

BRIEF DESCRIPTION OF THE DRAWINGS

Non-limiting examples of various embodiments of the present disclosure are described in the following and are depicted in the accompanying drawings, in which.

DETAILED DESCRIPTION

Figure 1:
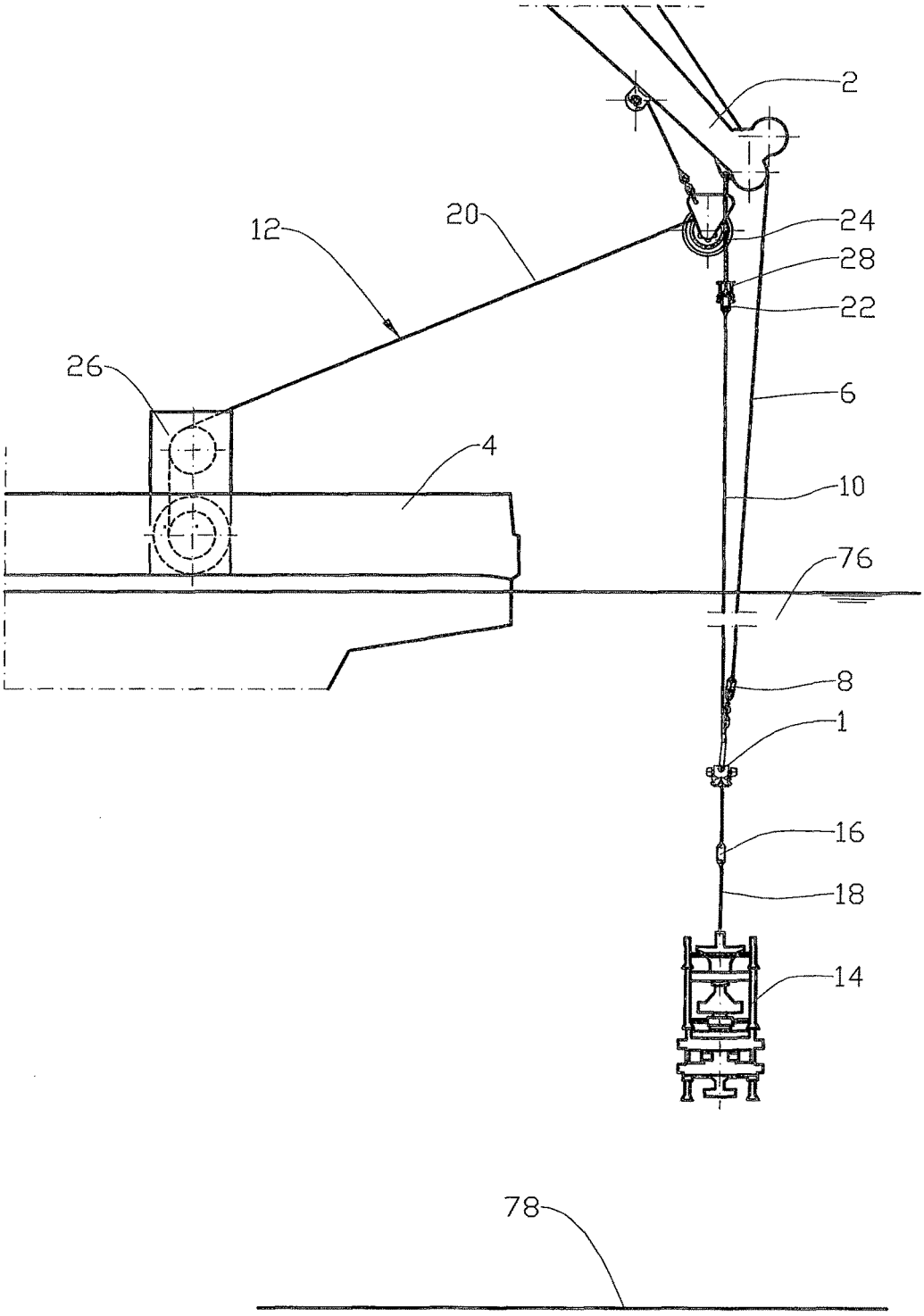
FIG. 1 shows an exemplary layout of a lifting operation in accordance with various embodiments of the present disclosure.
Figure 2:
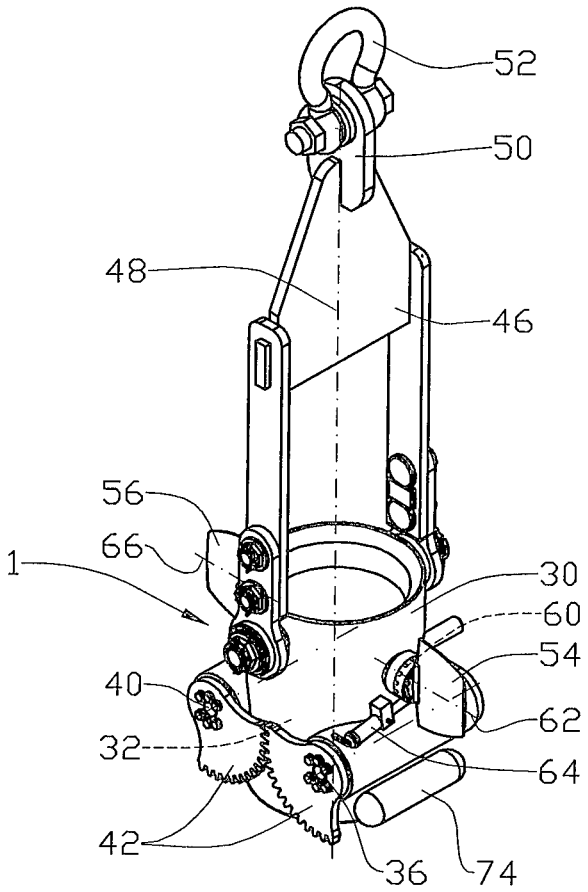
FIG. 2 shows an enlarged, perspective view of a lifting tool in accordance with various embodiments of the present disclosure.
Figure 3:
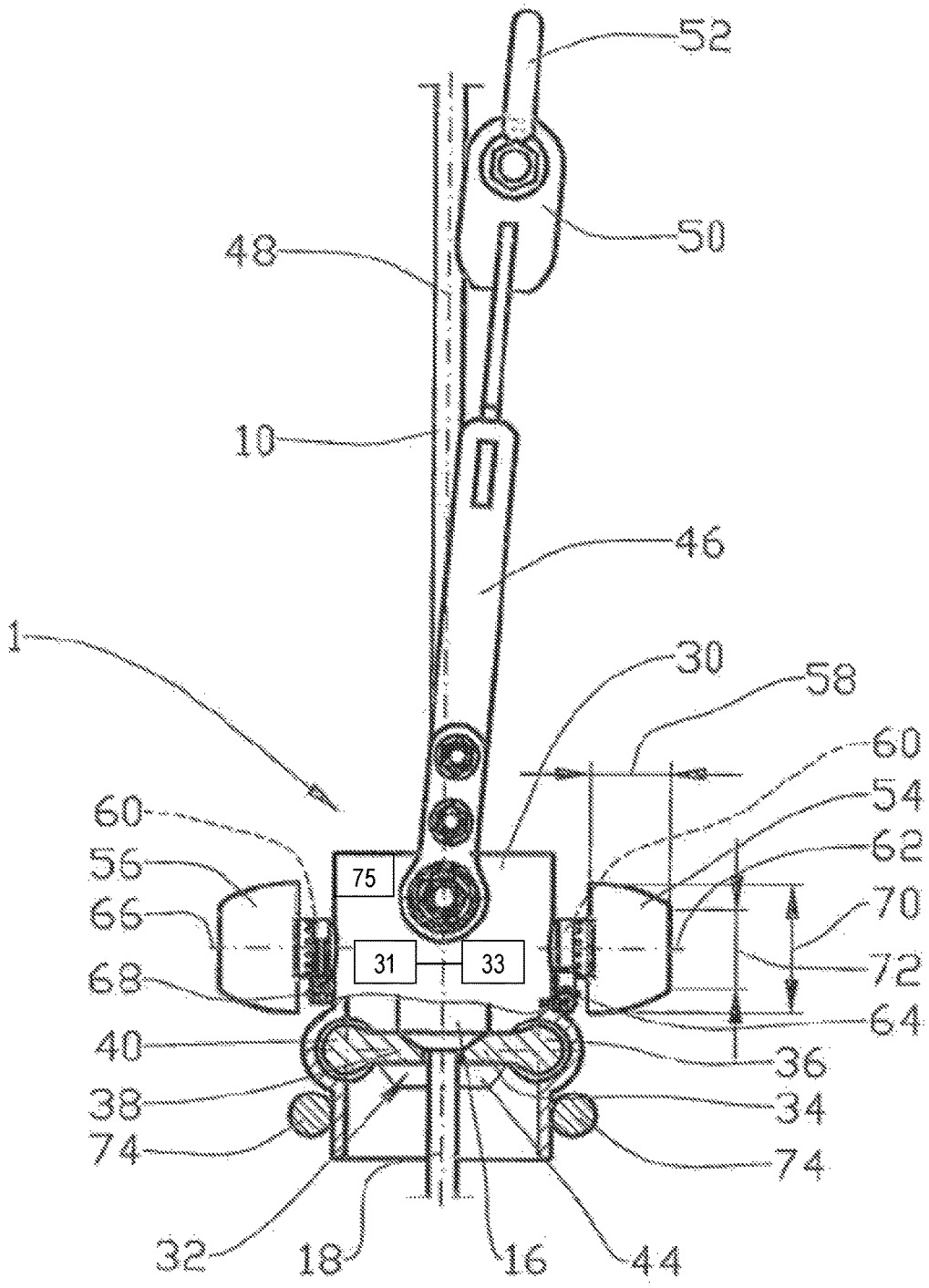
FIG. 3 shows a partial cross-section, side view of the lifting tool shown in FIG. 2 in accordance with various embodiments of the present disclosure.

Referring to FIGS. 1-3, the reference number 1 denotes a lifting tool that is connected to a crane 2 on a vessel 4 by a steel rope 6 and a lifting hook 8. The lifting hook 8 includes a swivel, which is not shown.

FIG. 1 shows a first fiber rope section 10 of a fiber rope 12 passing through the lifting tool 1. The first fiber rope section 10 is partly connected at its lower end to an item 14 (e.g., a payload) via a first rope connector 16 and an intermediate rope 18. At its opposite upper end the first fiber rope section 10 is connected to a second fiber rope section 20 via a second rope connector 22.

The second fiber rope section 20 extends over a sheave 24 on the crane 2, to a feed mechanism 26 on the vessel 4.

In FIG. 1, the second rope connector 22 is shown in a locked position in a hanger 28 on the crane 2. The lifting force generated by the item 14 is thus carried by the first fiber rope section 10 and the crane 2, and not by the second fiber rope section 20.

Turning to FIG. 2, the lifting tool 1 includes a generally pipe formed body 30 having an operable lock 32 that is adapted to catch a rope connector 10, 22 as the fiber rope 12 passes through the body 30.

Referring to the lifting tool 1 of FIGS. 2 and 3, the lock 32 is shown including a first lock party 34 that is fixed to a first shaft 36, and a second lock party 38 that is fixed to a second shaft 40. Other forms of locking mechanisms may be applicable.

The two shafts 36, 40 are rotationally interconnected by toothed sectors 42. The lock parties 34, 38 are movable by a lock actuator, not shown, between an active locked position as shown in FIG. 3, where the lock parties 34, 38 rest on a protrusion 44 in the body 30, and an open position, not shown, where the lock parties 34, 38 are turned upward so the rope connector 10 may pass through the body 30.

An upper structure 46 is pinned to the body 30 and allowed to swing a limited amount out from the center axis 48. The structure 46 includes a padeye 50 for a shackle 52.

Figure 4:
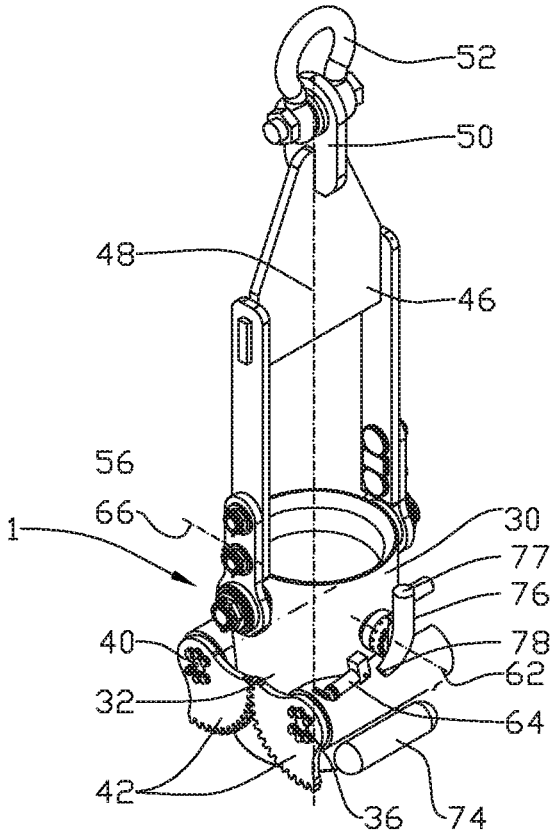
FIG. 4 shows an enlarged, perspective view of a lifting tool in accordance with various embodiments of the present disclosure.

The body 30 is equipped with a first rudder 54 and a second rudder 56 protruding with their span 58 in a radial direction of the body 30. As the first and second rudders 54, 56 are connected to the body 30 by bearings 60, the first rudder 54 may be turned about a first axis 62 by a first actuator 64 while the second rudder 56 may be turned about a second axis 66 by a second actuator 68. In some embodiments, a rudder control unit 31 receives data indicating a value of rotational acceleration or inclination of the body 30 from one or more sensors 33. The rudder control unit 31 may communicate with the first and second actuators 64, 68 to cause the actuators 64, 68 to alter a characteristic of the first and second rudders 54, 56, such as their position about the first axis 62 and the second axis 66. Additionally, as shown in FIG. 4, a nozzle 76 may be used to oppose rotational motion of the body 30 by positioning an inlet 77 of the nozzle 76 in the lifting direction and directing water flow for the nozzle through an outlet 78 of the nozzle tangentially relative the lifting tool body 30. A control unit 31 may similarly communicate with an actuator to cause the actuator to alter a characteristic of the nozzle 76, such as fluid flow rate through the nozzle 76.

The rudders 54, 56 of the present embodiment are substantially symmetrical about the respective axis 60, 64. The axes 60, 64 are generally parallel with the span 58 and the rudder's 54, 56 root chords 70 are longer than their tip chords 72. Energy for operation of the actuators 64, 68 may be stored on the lifting tool 1, for example as pressurized drive fluid stored in containers 74, or as an electrical charge in a batter 75.

Various equipment, cables, and pipes for the operation of the actuators 62, 66 are not shown on the drawings.

When an item 14 is to be lowered into the sea 76 and down to the sea floor 78, the first rope connector 16 is prevented from passing through the body 30 by the lock 32 as shown in FIG. 3.

The first fiber rope section 10 is paid out from the feed mechanism 26 while the crane 2 is bearing the load of the item 14 via the steel rope 6, the lifting tool 1, the first rope connector 16, and the intermediate rope 18.

As the lifting tool 1 descends through the sea 76, the rudders 54, 56 are adjusted to oppose torques from the sources described above, preventing the steel rope 6 from becoming entangled with the first fiber rope section 10.

When the second rope connector 22 interlocks with the hanger 28, the payload is taken over from the steel rope 6 by the first fiber rope section 10.

The lifting tool 1 is released from the first rope connector 10 by moving the lock parties 34, 38 to their open position. The lifting tool 1 may be moved upwardly along the first fiber rope section 10 as shown in FIG. 1, the rudders opposing rotation of the lifting tool 1, continuing to prevent the steel rope 6 from becoming entangled with the first fiber rope section. The lifting tool 1 then latches in with the second rope connector 22. When the hanger 28 unlatches from the second rope connector 22, the crane 2 may lower the first fiber rope section 10, now carrying the payload, while the second fiber rope section 20 is paid out over the sheave 24 largely unloaded.

The invention claimed is:

1. A lifting tool for opposing twisting of generally submerged ropes, the lifting tool comprising:

a body with a center axis, the body having an operable lock configured to selectively limit movement of a rope connector through the body;

a structure coupled to the body and configured to couple to a hoist or crane;

at least one rudder positioned at a radial distance along a radial axis from the center axis, the at least one rudder having a shape that is substantially symmetrical about the radial axis; and a control unit configured to alter a position of the at least one rudder to oppose rotation of the lifting tool.

2. The lifting tool according to claim 1 wherein the rudder is adjustable with respect to a fluid flow direction.

3. The lifting tool according to claim 1 wherein the lifting tool comprises a pair of rudders positioned on opposite sides of the lifting tool.

4. The lifting tool according to claim 1 wherein the rudder is turnable about the radial axis in the direction of the span of the rudder.

5. The lifting tool according to claim 1 further comprising an actuator to turn the rudder about the radial axis in the direction of the span of the rudder.

6. The lifting tool according to claim 5 wherein energy for operation of the actuator is stored on the lifting tool.

7. The lifting tool according to claim 6 wherein the energy is stored in the form of a pressurized fluid.

8. The lifting tool according to claim 6 further comprising a battery to store the energy for operation of the actuator.

9. The lifting tool according to claim 1 further comprising:

a sensor to:

detect a rotational acceleration or inclination of the body; and generate data indicative of a value of the rotational acceleration or inclination of the body; and wherein the control unit is further configured to:

receive the data from the sensor; and alter the position of the rudder based on the data from the sensor.

10. The lifting tool according to claim 9 wherein the rudder control unit further comprises an actuator to alter the position of the rudder about the radial axis in the direction of the span of the rudder.

11. The lifting tool according to claim 1, wherein the at least one rudder has a truncated shape.

12. The lifting tool according to claim 1, wherein the at least one rudder comprises a tip chord and a root chord, the tip chord and the root chord defined by linear edges.

13. The lifting tool according to claim 12, wherein the root chord is configured to be longer than the tip chord.

* * * * *